US007931165B2

(12) United States Patent
Croy

(10) Patent No.: US 7,931,165 B2
(45) Date of Patent: Apr. 26, 2011

(54) PLAN-PRO™ PORTABLE BLUEPRINT CARRIER AND RETRACTABLE DISPLAY

(76) Inventor: Channon C. Croy, Elkton, VA (US)

( * ) Notice: Subject to any disclaimer, the term of this patent is extended or adjusted under 35 U.S.C. 154(b) by 966 days.

(21) Appl. No.: 11/484,999

(22) Filed: Jul. 13, 2006

(65) Prior Publication Data

US 2008/0011622 A1 Jan. 17, 2008

(51) Int. Cl.

| | |
|---|---|
| ***B65D 21/02*** | (2006.01) |
| ***B65D 1/40*** | (2006.01) |
| ***B65D 75/00*** | (2006.01) |
| ***A45F 5/00*** | (2006.01) |

(52) U.S. Cl. ..... 220/23.86; 220/23.83; 220/735; 206/163; 206/165; 206/166; 434/73; 224/183

(58) Field of Classification Search ..... 220/23.83, 220/23.86, 735; 206/163, 165, 166; 224/183, 224/562; 434/73, 168, 190

See application file for complete search history.

(56) References Cited

U.S. PATENT DOCUMENTS

| | | | | | |
|---|---|---|---|---|---|
| 948,506 | A | * | 2/1910 | Horton | 40/514 |
| 3,105,279 | A | * | 10/1963 | Westhoff | 24/67.5 |
| 3,884,351 | A | * | 5/1975 | James | 206/225 |
| 3,965,599 | A | * | 6/1976 | Ebner | 40/711 |
| 4,301,205 | A | * | 11/1981 | Seltenheim et al. | 428/127 |
| 4,334,373 | A | | 6/1982 | Bryan | |
| 4,574,504 | A | * | 3/1986 | Holmer | 40/660 |
| 4,576,279 | A | * | 3/1986 | Ferderber | 206/225 |
| 4,679,822 | A | * | 7/1987 | Wolfe | 281/5 |
| 5,028,075 | A | | 7/1991 | Donnelly | |
| 5,161,656 | A | * | 11/1992 | Brenner | 190/111 |
| 5,359,797 | A | * | 11/1994 | Williamson | 280/816 |
| 5,407,230 | A | | 4/1995 | Brink-Keable | |
| 5,639,240 | A | * | 6/1997 | Werzberger | 434/88 |
| 5,738,460 | A | | 4/1998 | Flynn | |
| 5,941,476 | A | * | 8/1999 | Copass | 242/588.6 |
| 6,684,541 | B2 | * | 2/2004 | McPhaul | 40/517 |
| 6,805,237 | B2 | | 10/2004 | Curry | |
| 2003/0047578 | A1 | * | 3/2003 | Barnett | 224/562 |

* cited by examiner

*Primary Examiner* — Anthony Stashick
*Assistant Examiner* — Madison L Wright
(74) *Attorney, Agent, or Firm* — Daniel L. Fitch; Wharton, Aldhizer & Weaver, PLC

(57) ABSTRACT

A portable carrier for storing and displaying rolled blueprints and other construction documents ("Carrier"). The Carrier includes a compact storage case with an opening for the passage of flexible backing material and documents. A cylindrical roller, mounted inside of the compact storage case, rotates axially to allow unfurling and retracting of flexible backing material. Means for unfurling and retracting the flexible backing material are provided, utilizing a retracting handle and a manual retractor cap respectively. Means for attaching and detaching display documents are provided using Velcro® Brand material affixed to the top of the flexible backing material and mating document Velcro® Brand fastening strips attached to the backs of the display documents. Documents are held down during display using a document fastener assembly. The Carrier can be fastened to common construction surfaces during flat display using padded magnets or grooved slots positioned on the retracting handle and compact storage case.

3 Claims, 18 Drawing Sheets

PLAN-PRO™ PORTABLE BLUEPRINT CARRIER AND RETRACTABLE DISPLAY

CROSS REFERENCE TO RELATED APPLICATION

Not Applicable

FEDERALLY SPONSORED RESEARCH

Not Applicable.

SEQUENCE LISTING PROGRAM

Not Applicable.

BACKGROUND OF THE INVENTION

1. Field of the Invention

This invention relates to a portable carrier for the storage and flat display, both indoors and outdoors, of blueprints, graphs, maps, and other large documents.

2. Prior Art

Architects, engineers, contractors, and others involved in the building trades often need to transport important contract documents, particularly blueprints or surveys, to project sites for flat display and reference during the construction process. A similar need to transport and display documents in a field setting exists among cartographers, surveyors, and others involved in the mapping and surveying trades.

Typically, these large documents, sometimes 24 inches×36 inches in size, or larger, are bundled together in sets by design professionals or surveyors. These bulky documents are often difficult to transport and challenging to display, especially in field conditions. Moreover, because most construction projects require many months and sometimes years to complete, these important documents are subject to deterioration or damage, as they are subject to repeated handling, the elements, and/or unprotected storage.

At best, these documents are usually rolled up and put in cardboard or plastic storage tubes. More commonly, they are rolled up and secured by a rubber band. In either event, when the documents are removed from the tube or unbanded, having been rolled-up, they are hard to keep flat for display purposes. Additionally, the edges are subject to tears, curling, and warping. Folding these large documents is generally not favored as the creases degrade the integrity of the information depicted, making tearing more likely and the taking of scaled measurements more difficult. In many instances, the sheer bulk of a rolled set of blueprints makes folding an unrealistic option.

As noted, the elements pose a significant threat to the integrity of these documents as the weeks and months of construction or field work progress. Sun tends to fade the ink, making the detailed information of the face of the documents more difficult to read. Rain and other forms of precipitation tend to warp and cause irregularities on the surface of the documents. Wind tends to rip at the documents and cause tears. Dust, dirt, and other debris tend to obscure or damage the face of the documents. Given the importance of obtaining accurate scaled measurements from these documents during the construction process, these are serious problems.

Compounding the problem of preserving these documents in a useable condition over protracted periods of time, the documents themselves are unwieldy and difficult to display. For instance, early in construction, blueprints are often unrolled across the hood or tailgate of a vehicle and held down with rocks or other available weights. In other instances, these documents are spread out on available surfaces, or simply left lying around the project site, unprotected, until needed.

On projects of significant scope, the number of blueprints, surveys, and other large drawings becomes quite large. Keeping them organized and quickly accessing and displaying the needed document in a flat fashion becomes increasingly difficult.

The foregoing problems are not unique to just blueprints and other construction-related documents. Other documents, large and small, need to be kept in good condition for long periods of time, while being accessible for quick and easy flat display. These documents include photographs, maps of all kinds, surveys, and other written/graphical reports.

Inventors have created several types of holders and folders to contain and view blueprints and photographic prints. U.S. Pat. No. 4,334,373 to Bryan (1982) discloses a combined flat sheet display device and rolled sheet holder. The holder tube is intended solely to store rolled blueprints and does not function, as the present invention does, to allow documents to be retracted to and unfurled from the cylinder onto a flat sheet display. There is no functional relationship between the cylindrical tube and the flat sheet display in the '373 Patent. The flat display is static, relatively small in dimension, and intended solely to protect a single document (e.g. a building permit) from the elements. The invention is not portable, but rather intended to remain at the project site as a storage device for blueprints and a display for the building permit.

U.S. Pat. No. 5,028,075 issued to Donnelly (1991) discloses a portable carrier for containing and displaying blueprints in an outdoor work environment. The carrier is comprised of a rectangular sheet of substantially rigid material and expandable living hinge with restraining clamps to lock large blueprints in place. Essentially, the carrier is a folio which is dimensioned to be approximately the size of at least one of the documents contained within, plus a substantial border around the contained documents. In the case of blueprints, this carrier is in excess of 2 feet in width and 3 feet in length. Blueprints, or other display documents, cannot be retracted into the carrier and no provision is made to secure the portable carrier, magnetically or mechanically, to common construction surfaces, such as vehicle hoods, tailgates, or wall studs.

U.S. Pat. No. 5,407,230 issued to Brink and Keable (1995) discloses another folder adapted to contain and view photographic prints and the like. The folder provides a means for viewing a series of photographs arranged and mounted in a manner similar to the pages of a book. In its preferred embodiment, the invention is a book-like folder including a relockable closure. It does not allow for the display of large construction documents, like blueprints, and does not permit the documents or flat display surface to be retracted from and rolled into a compact storage cylinder after display.

U.S. Pat. No. 5,738,460 issued to Flynn (1998), discloses yet another portfolio type device to carry and display blueprints. Sealed plastic sheet protectors are fastened in a ringed binder enclosed by a durable outer shell. The book style case fixes the substantial dimensions of the device. It must be large enough to accommodate oversized sheet protectors when in the closed position. It does not allow for the unfurling and retraction of the documents into a compact cylindrical storage tube. The portfolio does not provide a means for magnetically or mechanically fastening the flat display to common construction site surfaces, including vehicle surfaces.

U.S. Pat. No. 6,805,237 issued to Curry (2004) discloses a portable carrier for containing and displaying blueprints in an outdoor work environment. It comprises a rectangular box of substantially rigid material and has removable legs to allow it to be laid flat or posted on a wall for field use. The device, being of fixed dimensions, does not allow for blueprints and the flat display surface to be retracted after use. Its portability is limited by its large and rigid geometry.

Each of the foregoing inventions suffers from a number of common disadvantages.

a) Their folio, book-like, or box-like geometry is not suited to unfurling and retracting the blueprints and other documents into a compact storage case following display.

b) None of the devices allow for the unfurling of rolled documents onto a flat display surface and the retracting of those same documents into a compact storage case. In the case of the '373 patent for example, there is no functional relationship between the storage tube and the flat display.

c) None of the devices have magnetic strips to fasten the carrier to the metal surfaces of construction vehicles or to other metallic construction surfaces (e.g. metal tables, or metal wall studs) during flat display.

d) None of the devices have slots designed to receive protruding nail heads to fasten the carrier to other surfaces (e.g. nails protruding from wall studs) during flat display.

e) The true portability of the patented blueprint carriers is limited by the substantial size of the folios or boxes which must be large enough to contain unfolded blueprints. Many of the inventions are not truly compact storage carriers.

f) The expense and bulk of a large book-like or box-like folio carrier means that on a project with a substantial number of blueprints, documents must frequently be transferred into and out of the carrier for display purposes. Having a large number of carriers makes little sense given the cost and cumbersome dimensions. Older and damaging means of storage (e.g. tubes or rubber banding rolled blueprints) are likely used as fall backs for managing excess documents.

f) The fasteners used to display the documents are, in some instances, capable of creasing, damaging or tearing the paper being held.

OBJECTS AND ADVANTAGES

Accordingly, besides the clear objects and advantages of compact storage and quick and easy flat display, several objects and advantages of the present invention are:

a) To provide a compact carrier for rolled documents, such as blueprints, to be unfurled from a rigid storage case, cylindrical in its preferred embodiment, form molded into a flat rectangular base, for display on flat surfaces in both indoor and outdoor settings.

b) To provide a cylindrical roller which rotates in either direction about its long axis inside of the compact storage case around which flexible backing material and documents, attached thereto, can be rolled and unrolled.

c) To provide a section of flexible backing material attached at one of its ends to the cylindrical roller for use as a flat display surface which can be unrolled from and retracted back into the cylindrical storage case.

d) To provide a document fastener assembly attached to the opposite end of the flexible backing material suitable for securing the end of an unfurled document for flat display using a snap fastener.

e) To provide a clip that extends the width of the flexible backing material to hold documents down during display.

f) To provide a retracting handle attached to the document fastener assembly suitable for pulling and unfurling the flexible backing material from the cylindrical case for use as a flat display surface.

g) To provide (i) padded magnetic strips and (ii) slots on the bottom surfaces of the compact storage case/rectangular base and the retracting handle for use in securing the carrier and unfurled flexible backing material to a flat display surface, either magnetically (e.g. magnets to metal surfaces) or mechanically (e.g. slots aligned with nail heads protruding from wall studs or other surfaces).

h) To provide a large surface area of VELCRO® brand hook and loop fastener material (e.g. hook side) affixed to the top surface of the flexible backing material for easy attachment and detachment of documents such as blueprints.

i) To provide document fastening strips such as STICKY BACK® brand hook and loop adhesive fasteners which have a permanent adhesive strip on one side, to be applied to the backs of single documents or a bundle of documents, such as blueprints, and mating strips of VELCRO® brand hook and loop fastener material (e.g. loop side) on the other side, to be used to fasten and unfasten documents to the surface area of VELCRO® brand hook and loop fastener material affixed to the top of the flexible backing material.

j) To provide a carrying handle on the top of the cylindrical case.

Further objects and advantages are to provide a carrier and display device which can be used easily and conveniently to store, transport, protect, and display blueprints, without damage to the documents; to allow sets of blueprints to be interchanged by a quick and easy means of attaching and detaching the back of the document or the set of documents to the large surface area of VELCRO® brand hook and loop fastener material using STICKY BACK® brand hook and loop adhesive fasteners; to secure on the width end of the document to be displayed using a snap fastener assembly and clip extending the width of the flexible backing material; to unfurl and retract the flexible backing material and/or documents manually upon a cylindrical roller or, in different embodiments to retract the flexible backing material and/or documents mechanically, using a single recoil spring or dual recoil springs; to allow for the fastening of the carrier for flat display to metallic and non-metallic surfaces, both horizontally and vertically; and to protect the documents in a compact storage case when not on display. Still further objects and advantages will become apparent from a consideration of the ensuing description and drawings.

SUMMARY

In accordance with the present invention a portable blueprint carrier and flat display device comprising a compact storage case with a carrying handle and a mounted scale rule, an interior cylindrical roller attached to a flexible backing material used as display surface with a document fastener and retracting handle, and means of unfurling, securing, displaying, retracting, and storing blueprints, graphs, maps, and other large documents.

DRAWINGS

Figures

DETAILED DESCRIPTION

FIGS. 1-23

Figure 1:
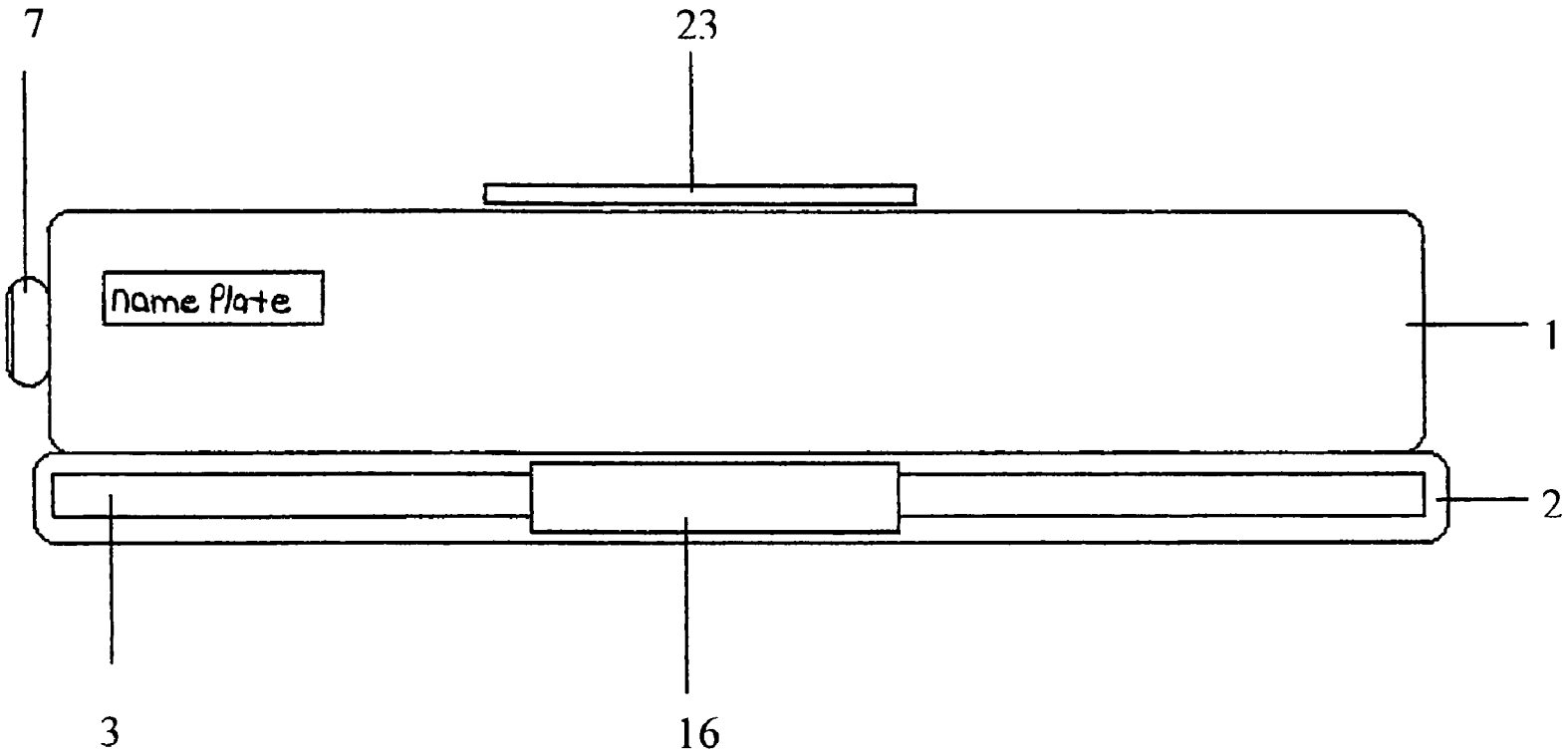
FIG. 1 shows the exterior of the compact storage case from the front.
Figure 2:
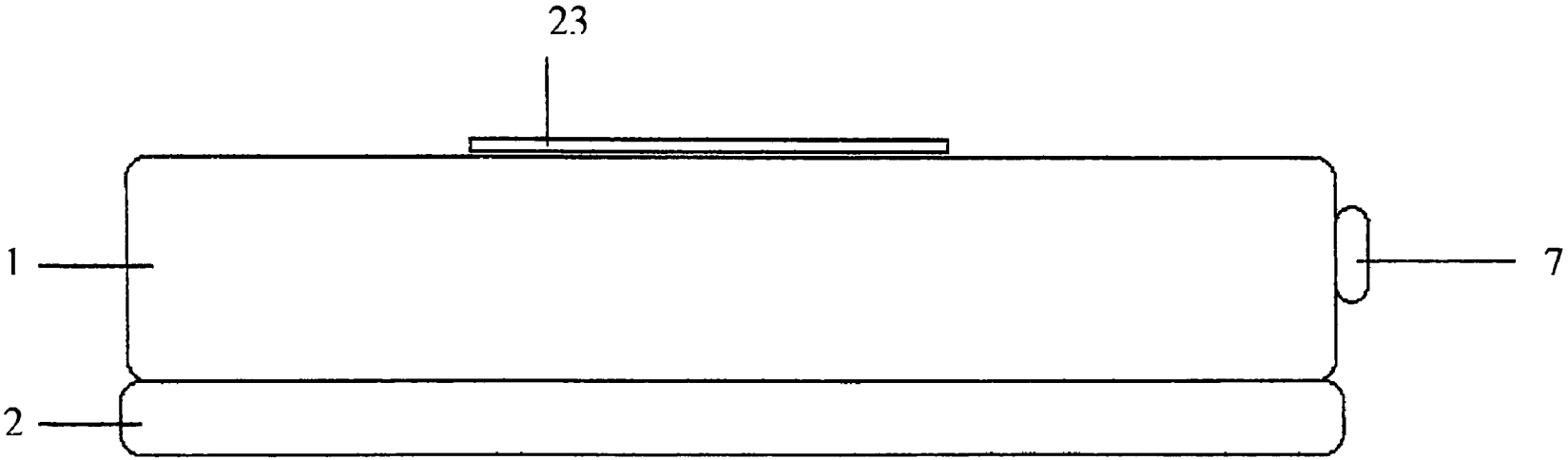
FIG. 2 shows the exterior of the compact storage case from the back.
Figure 3:
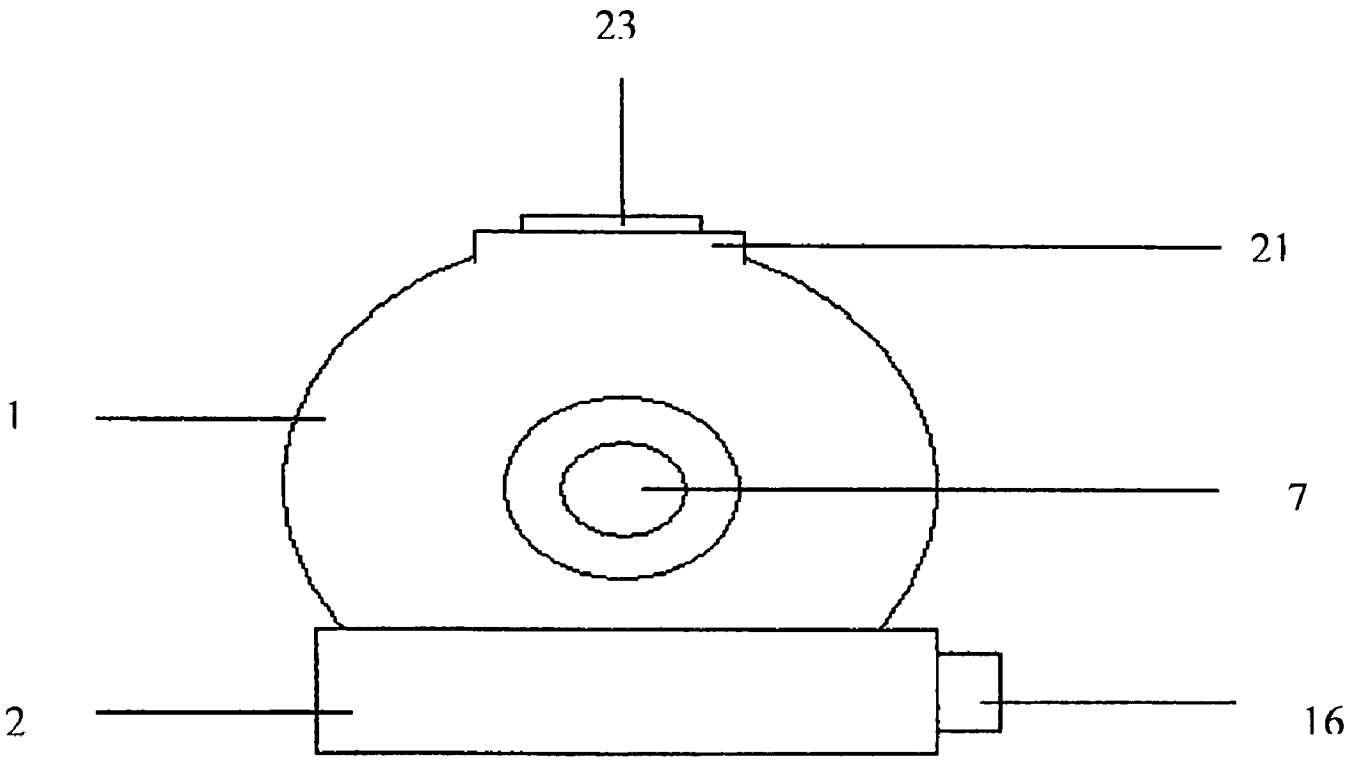
FIG. 3 shows the exterior of the compact storage case from the left side.
Figure 4:
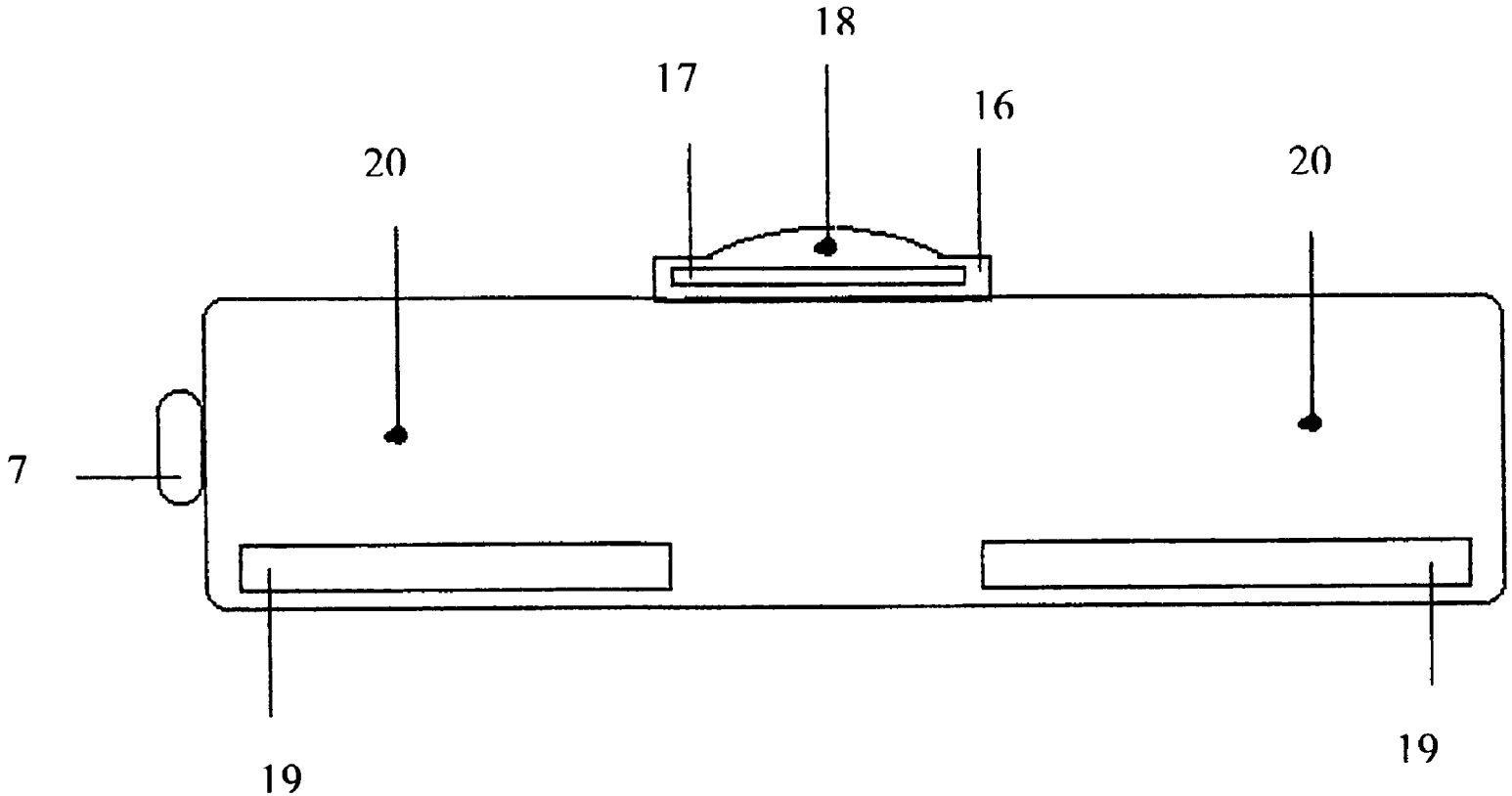
FIG. 4 shows the exterior of the compact storage case from the bottom of the base.
Figure 5:
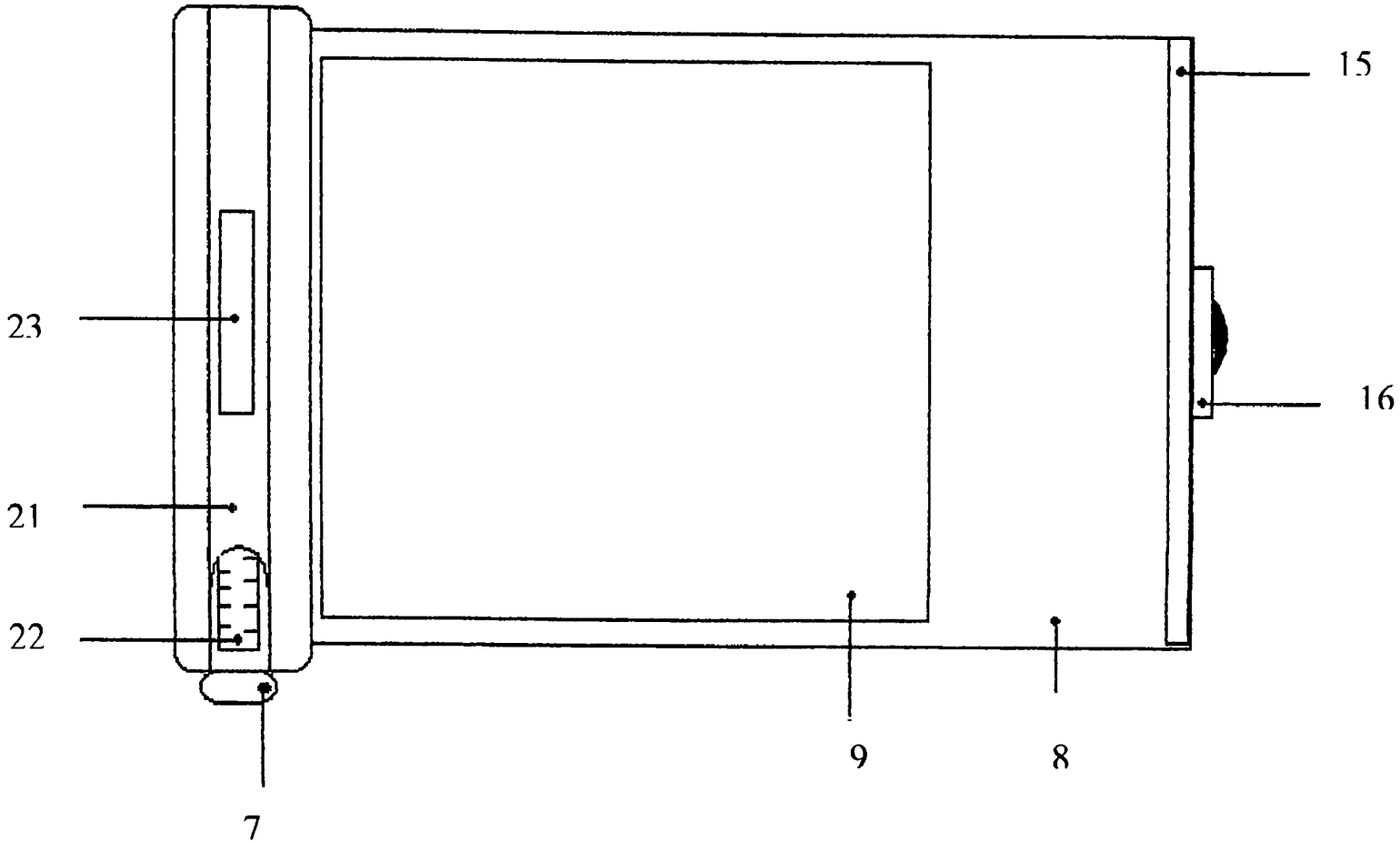
FIG. 5 shows the exterior of the compact storage case from the top with the flexible backing material fully retracted, upon which a large surface area of VELCRO® brand hook and loop fastener material (e.g. hook side up) is affixed. A square ridge used to hold the scale ruler is also shown.
Figure 6:
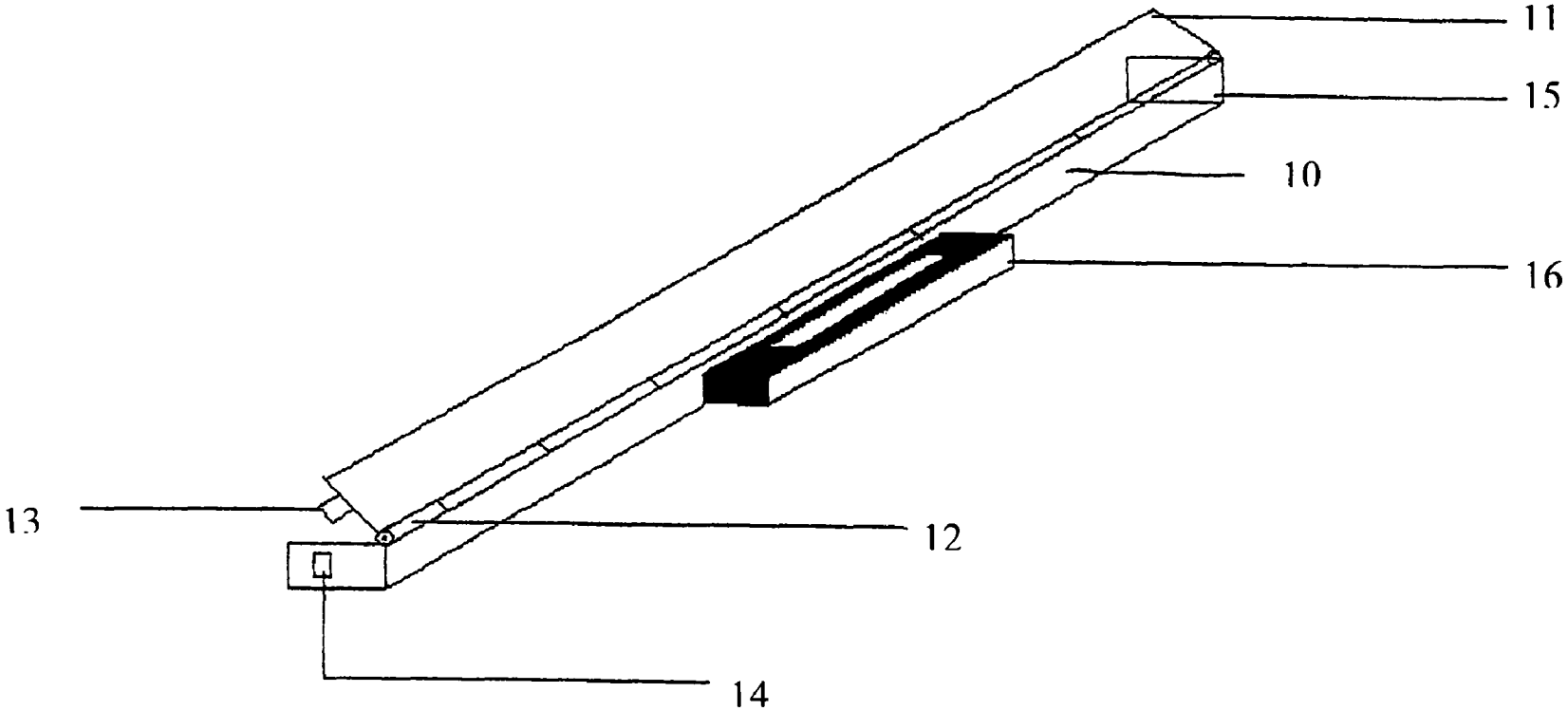
FIG. 6 shows the retracting handle and document fastener assembly.
Figure 7:
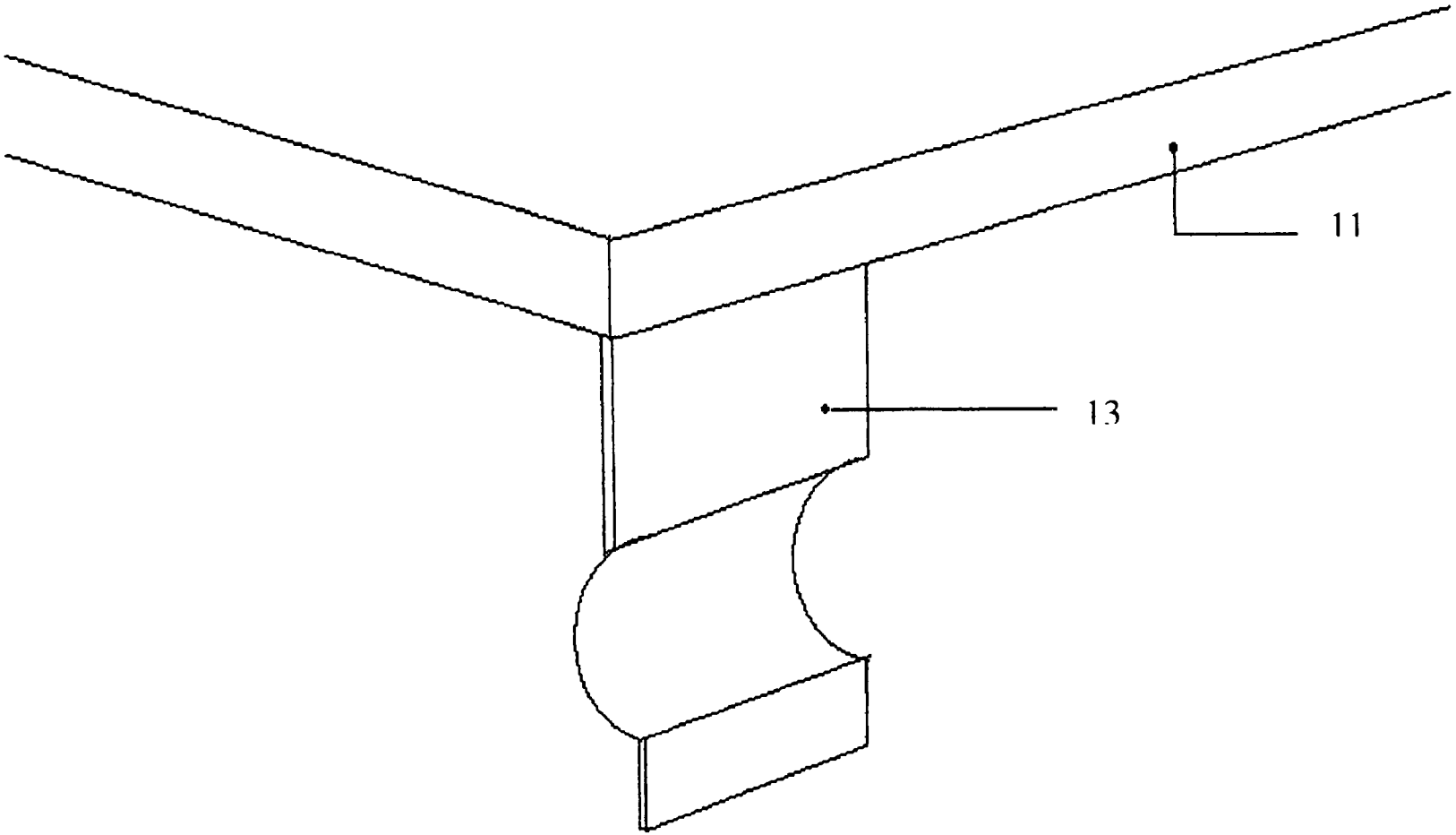
FIG. 7 shows a close-up of the folding lid and holding fastener.
Figure 8:
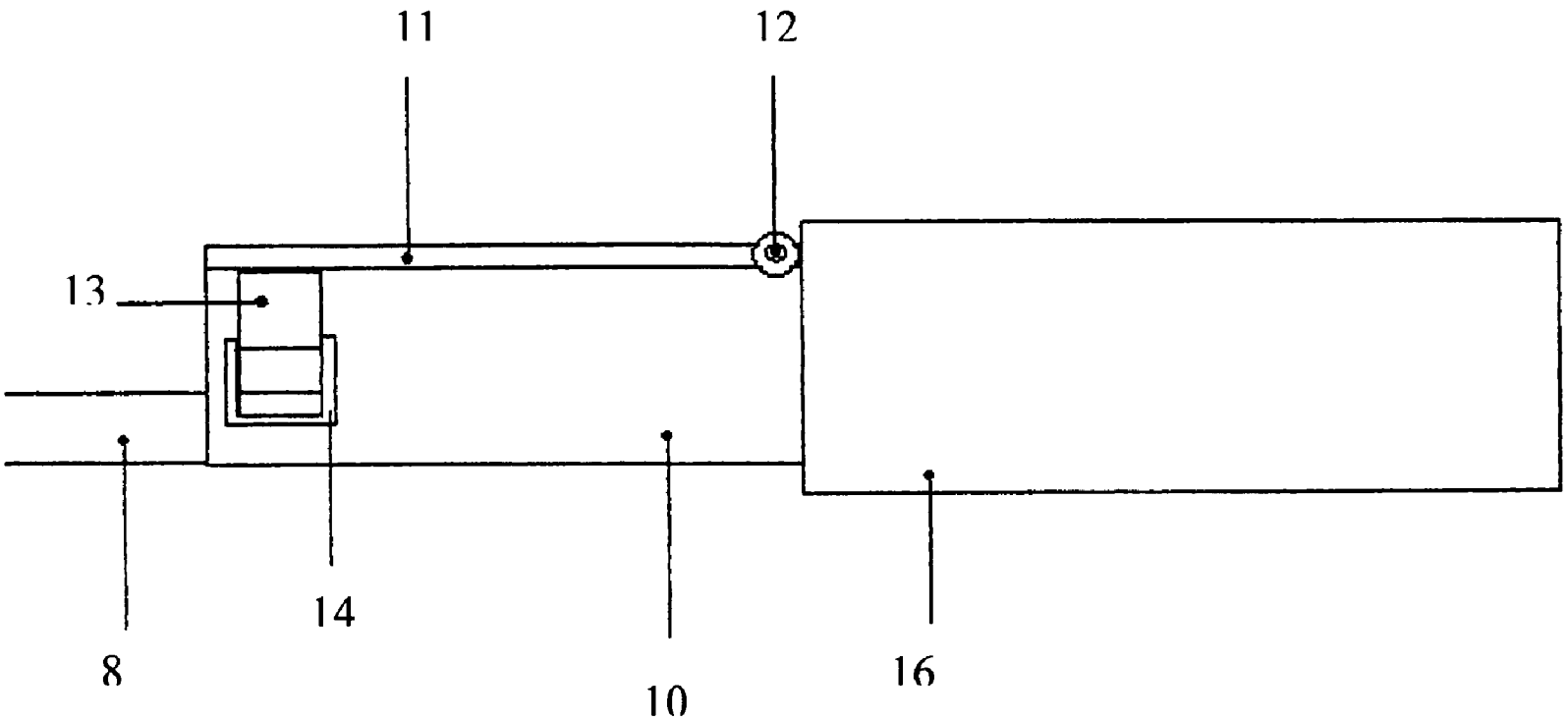
FIG. 8 shows a side view of the retracting handle and document fastener assembly.
Figure 9:
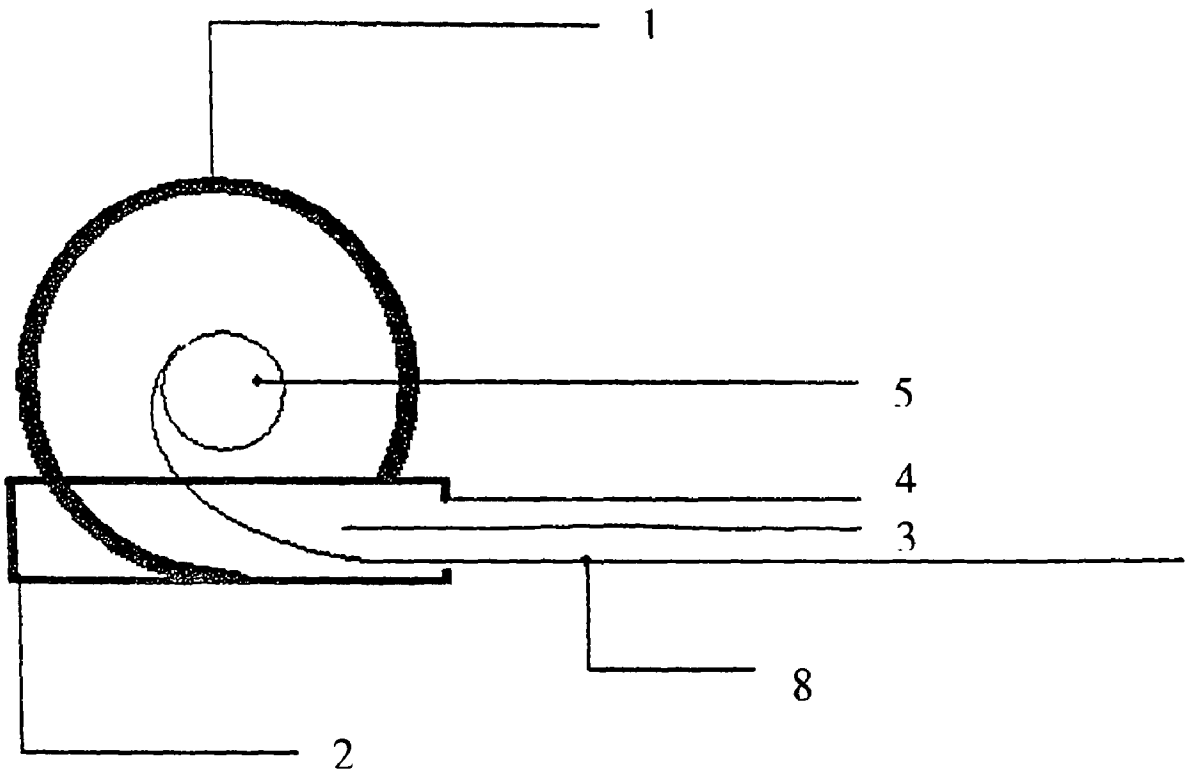
FIG. 9 shows a side view of the compact storage case, rectangular base, and flexible backing material.
Figure 10:
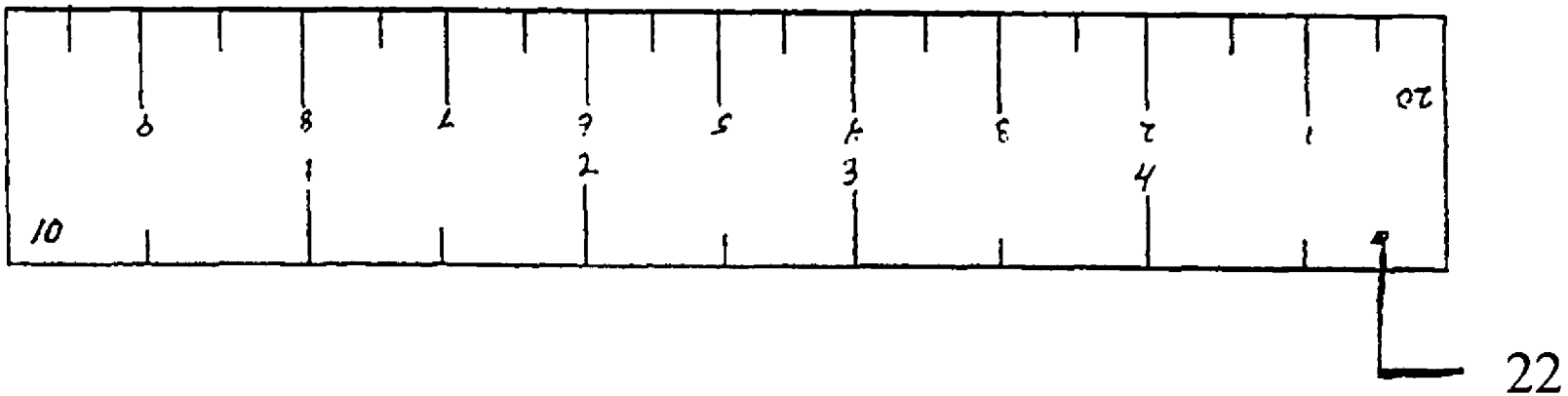
FIG. 10 shows a detachable scale rule, 10/20 on one side and 30/40 on the other.
Figure 11:
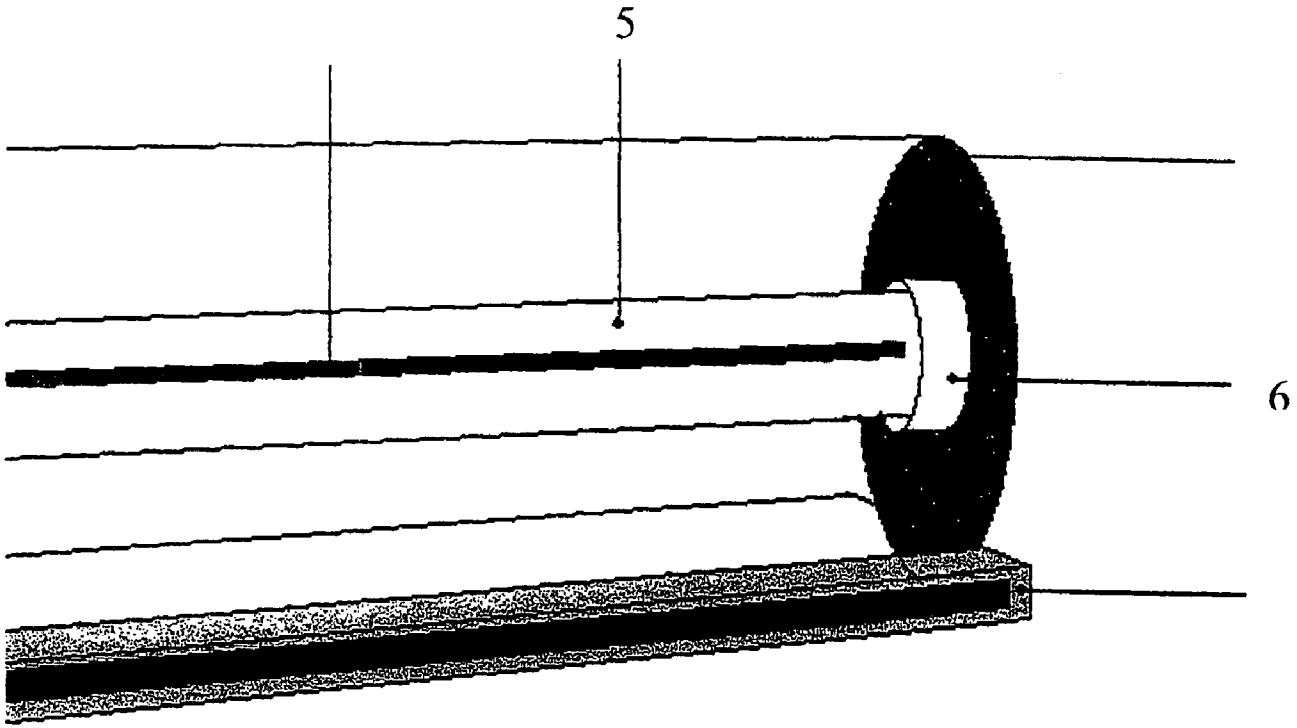
FIG. 11 shows the cylindrical roller seated into the cylindrical roller receiver at the interior end of the compact storage case.
Figure 12:
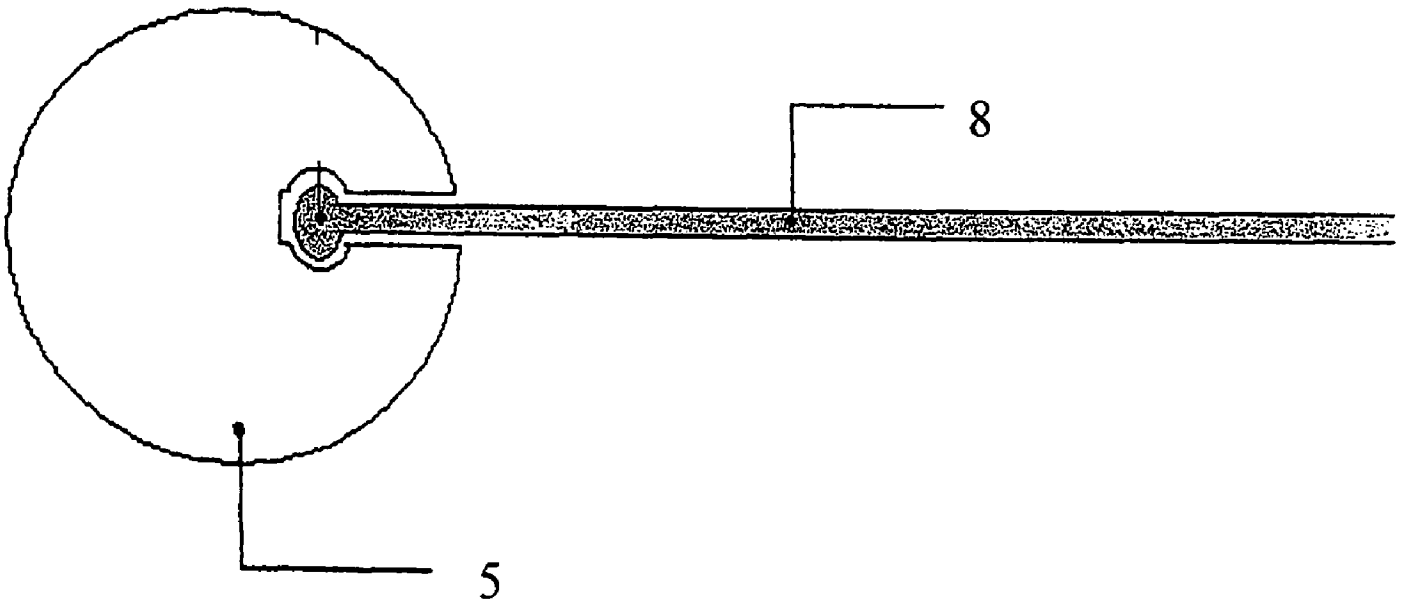
FIG. 12 shows the preferred means for attaching the flexible backing material to the cylindrical roller.
Figure 13:
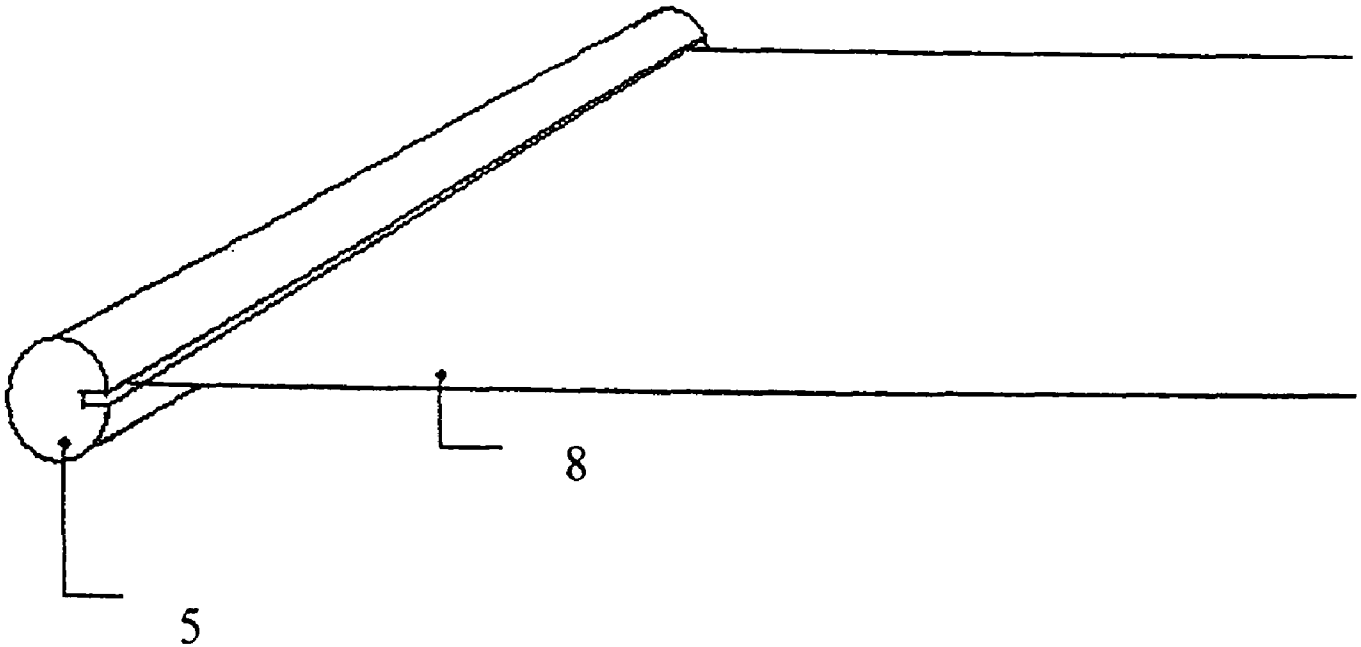
FIG. 13 shows one end of flexible backing material attached to the cylindrical roller using the preferred means.
Figure 14:
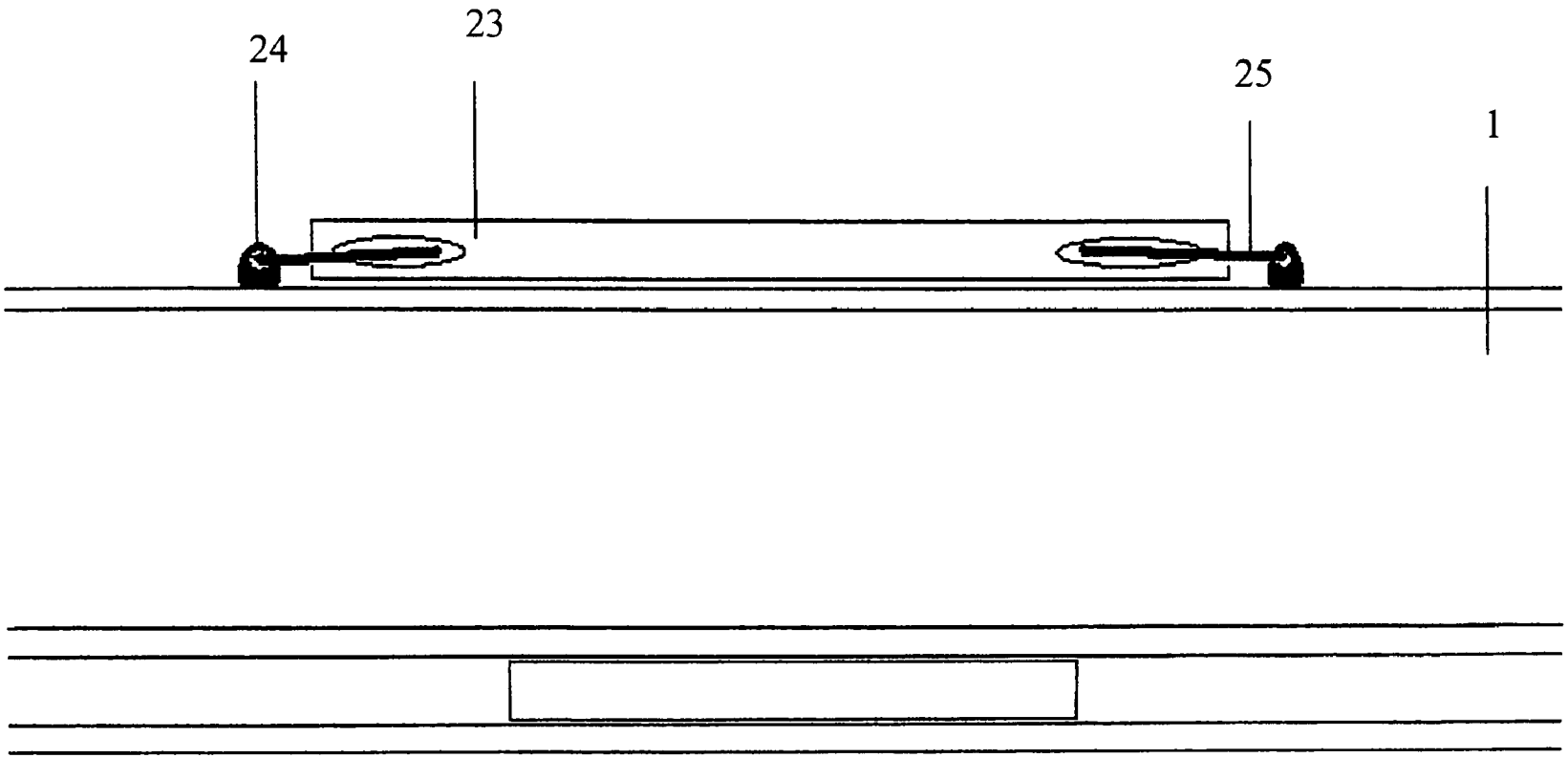
FIG. 14 shows the side view of the carrying handle in its preferred embodiment.
Figure 15:
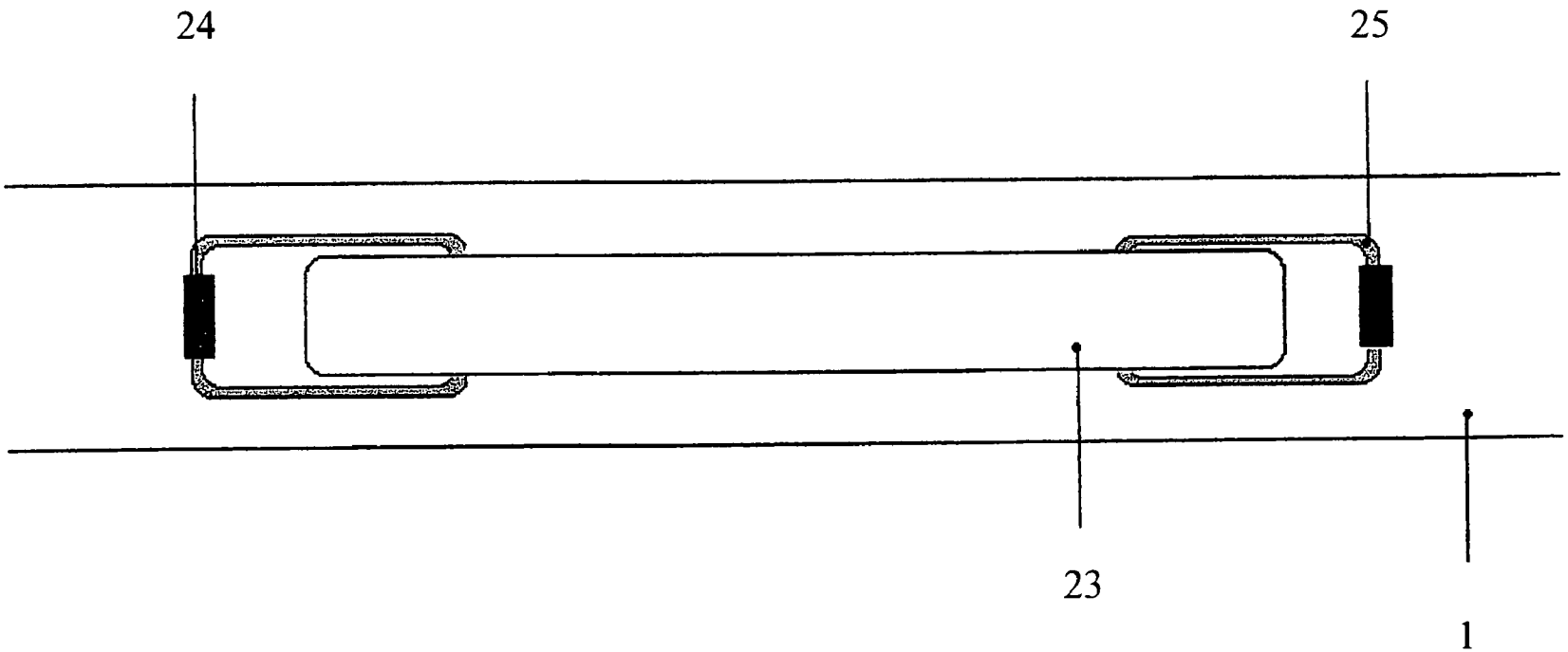
FIG. 15 shows the top view of the carrying handle in its preferred embodiment.
Figure 16:
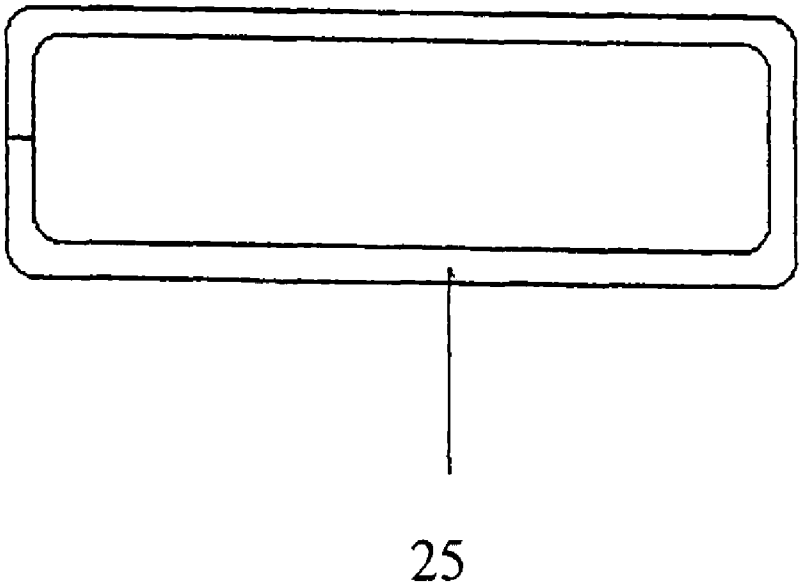
FIG. 16 shows the sliding tab used to link the carrying handle to the compact storage case.
Figure 18:
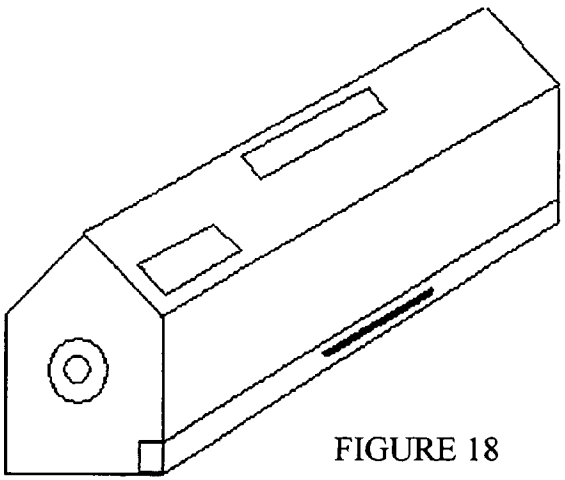
FIG. 18 shows the compact storage case, the geometry of its ends being a pentagon.
Figure 20:
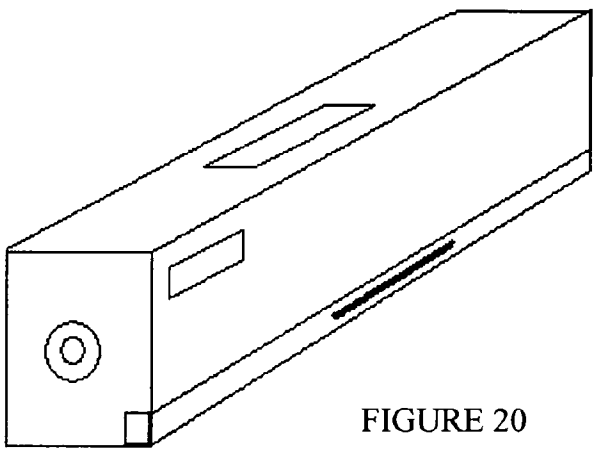
FIG. 20 shows the compact storage case, the geometry of its ends being a square.
Figure 17:
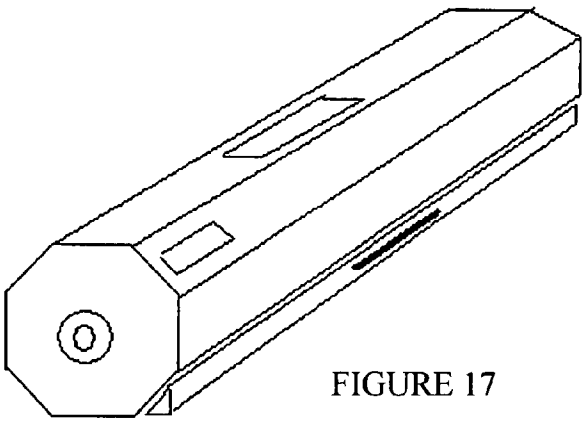
FIG. 17 shows the compact storage case, the geometry of its ends being an octagon.
Figure 19:
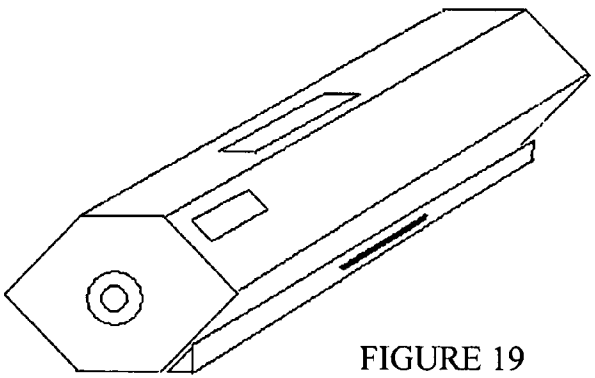
FIG. 19 shows the compact storage case, the geometry of its ends being a hexagon.

A preferred embodiment of the present invention is illustrated in FIG. 1 (front view), FIG. 2 (back view), FIG. 3 left (side view), FIG. 4 (bottom view), FIG. 5 (retracted view), FIG. 6 (retractor handle and document fastener assembly), FIG. 7 (folding lid and holding fastener), FIG. 8 (retracting handle and document fastener assembly), FIG. 9 (cylindrical storage case, rectangular base, and flexible backing material), FIG. 10 (detachable scale rule), FIG. 11 (cylindrical roller and cylindrical roller receiver), FIG. 12 (flexible backing material attachment), FIG. 13 (flexible backing material attached to cylindrical roller), FIG. 14 (carrying handle side view); FIG. 15 (carrying handle top view); FIG. 16 (sliding tab); FIG. 17 (octagonal storage case); FIG. 18 (pentagonal storage case); FIG. 19 (hexagonal storage case); and FIG. 20 (square storage case). The compact storage case 1 (FIGS. 1, 2, 3, 5, 9, 14, 15, 17, 18, 19 and 20) depicted is constructed of durable and lightweight material. In its preferred embodiment, the compact storage case is made of hard plastic. However, it can consist of any other durable and lightweight material suited for fabrication into a weather-proof storage tube, including aluminum, lightweight metal alloys, fiberglass, or laminates. In its preferred embodiment, the storage case is cylindrical, approximately 4 inches in diameter, and approximately 26 inches in length and seated into a rectangular base. It is designed to transport and store standard blueprints of either twenty-four or thirty-six inches in length. In another embodiment the storage case is square at its ends rather than circular, as provided in the preferred embodiment, and is not seated in a rectangular base. The ends of the compact storage case in its non-cylindrical embodiment may assume a variety of geometries (e.g. octagonal (FIG. 17, pentagonal (FIG. 18, hexagonal (FIG. 19) and square (FIG. 20)) so long as the compact storage case can accommodate a set of rolled documents (e.g. a bundle of blueprints).

As shown in the preferred embodiment, the compact storage case 1 (FIGS. 1, 2, 3, 5, 9, 14, and 15) is seated and form molded into a rectangular base 2 (FIGS. 1, 2, 3, 4, and 9), rectangular in all three dimensions, and deep enough to receive and secure the bottom section of the cylindrical case. In its preferred embodiment, the base also is made of hard plastic and is approximately ¾ inch in height, 4½ inches in depth, and 26 inches in length. Like the compact storage case, the rectangular base also can consist of any other durable and lightweight material suited for fabricating into a weather proof and crush proof base, including aluminum, lightweight metal alloys, fiberglass, or laminates. In other embodiments of the device where the ends of the compact storage case are geometric shapes other than circles (e.g. squares, hexagons, octagons, pentagons), no rectangular base is provided (FIGS. 17, 18, 19 and 20).

The compact storage case typically is of an equal thickness to the rectangular base. The compact storage case is fabricated and form molded with an opening 3 (FIGS. 1 and 9) which aligns with a corresponding form molded opening 4 (FIG. 9) on the front side of the rectangular base, both openings along substantially their entire length, designed to allow the flexible backing material and documents attached to the flexible backing material to pass through them as they are unfurled and retracted. The document fastener assembly 10 (FIGS. 6 and 8) is sized to fit squarely into the opening of the rectangular base.

Figure 21:
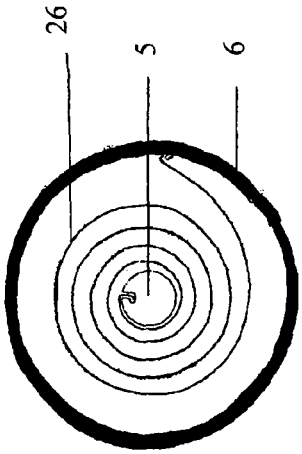
FIG. 21 shows the cylindrical roller, cylindrical roller receiver and recoil spring.
Figure 22:
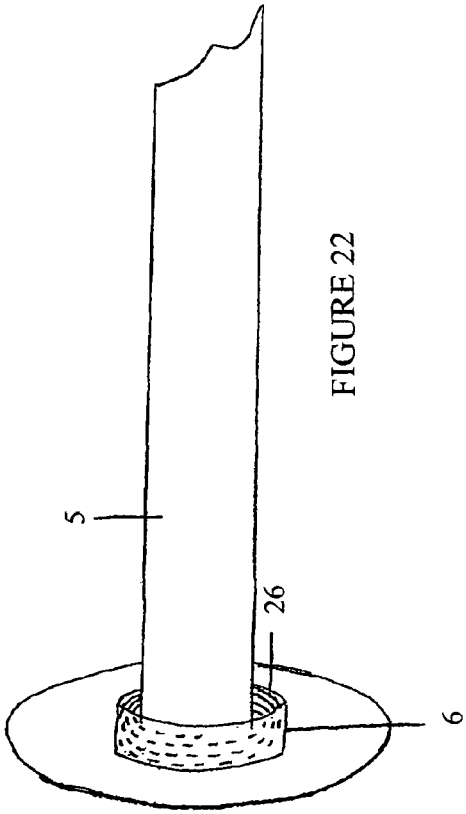
FIG. 22 shows the cylindrical roller, cylindrical roller receiver and single recoil spring.
Figure 23:
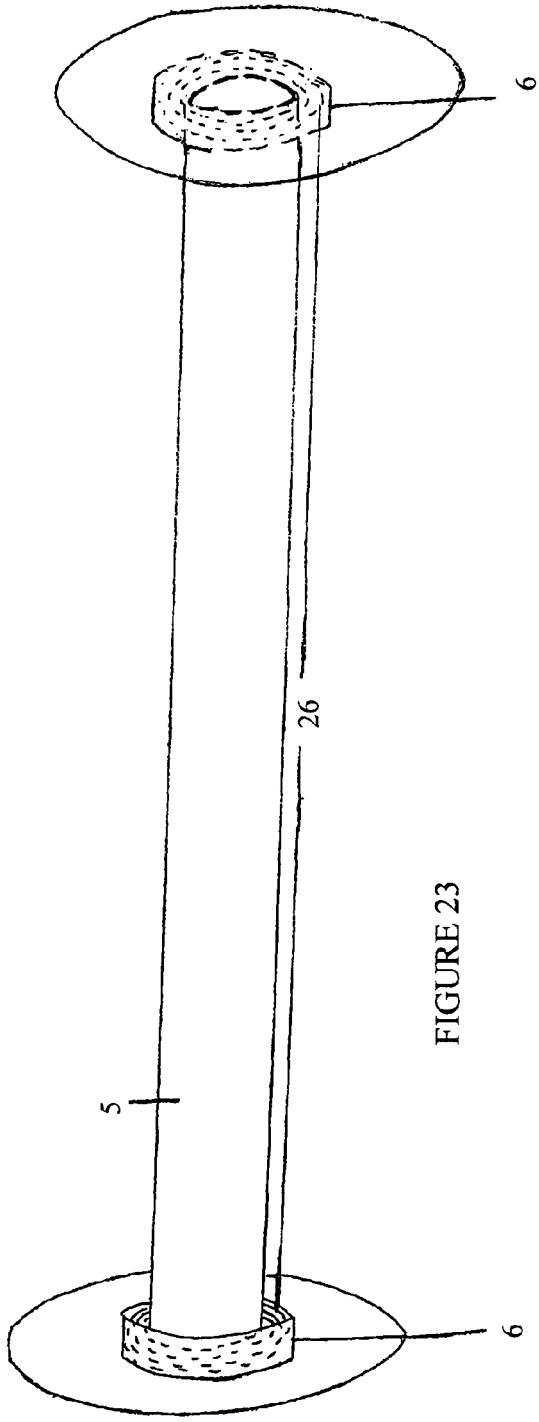
FIG. 23 shows the cylindrical roller, cylindrical roller receivers and dual recoil spring.

A cylindrical roller 5 (FIGS. 9, 11, 12, 13, 21, 22 and 23), having a smaller diameter than the diameter of the compact storage case is mounted inside of the full length of the compact storage case. In the preferred embodiment, the cylindrical roller is typically made of hard plastic. It also can consist of aluminum, fiberglass, wood, laminates, or other lightweight metal alloys. The cylindrical roller is seated at both interior ends of the compact storage case into a cylindrical roller receiver 6 (FIGS. 11, 21, 22, 23) which allows it to rotate freely about its long axis in either direction. Bearings (not illustrated) are seated between the cylindrical roller and the cylindrical roller receiver to smoothen the axial movements of the cylindrical roller. One end of the cylindrical roller is fitted with a retractor cap 7 (FIGS. 1, 2, 3, 4, and 5) which extends beyond the outside boundary of the cylindrical case. In the preferred embodiment, the retractor cap extends beyond the left end of the cylindrical case. The retractor cap is attached to the cylindrical roller by means allowing for the hand rotation of the cylindrical roller. This permits manual retraction of the flexible backing material and/or documents attached to the flexible backing material back upon the cylindrical roller and into the compact storage case. In another embodiment, the cylindrical roller is retracted mechanically, using a single recoil spring 26 connected to one end of the cylindrical roller and the cylindrical roller receiver (FIGS. 21 and 22). In still another embodiment, the cylindrical roller is retracted mechanically, using dual recoil springs connected to both ends of the cylindrical roller and cylindrical roller receivers (FIG. 23).

Fastened along the entire length of the cylindrical roller is one of the width ends of a piece of flexible backing material 8 (FIGS. 5, 8, 9, 12, and 13). The material may be of any flexible and durable composition such as vinyl or strong fabrics. In its preferred embodiment, the flexible backing material is a flexible and durable vinyl, rectangular in shape measuring approximately 25½ inches in width and 38 inches in length, and slotted into the cylindrical roller as shown (FIGS. 12 and 13).

Affixed to the top surface of the vinyl backing, nearest the cylindrical roller, is a large surface area of VELCRO® brand hook and loop fastener material 9 (FIG. 5). In the preferred embodiment, the hook side of the VELCRO® brand hook and loop fastener material is up. Document fastening strips such as STICKY BACK® brand hook and loop adhesive fasteners having a permanent adhesive backing on one side, used to fasten one side of the strip to the back of the documents to be displayed, and a mating strip of VELCRO® brand hook and loop fastener on the other side of the document fastening strip, used to attach the back of the display documents to the VELCRO® brand hook and loop fastener surface area, are provided. In the preferred embodiment, the loop side of the VELCRO® brand hook and loop fastener material is up on one side of the document fastening strip. The mating VELCRO® brand hook and loop fastener surfaces are used to quickly fasten and unfasten the back side of an individual document or roll of documents to the top of the flexible backing material.

A document fastener assembly 10 (FIGS. 6 and 8), used to secure one end of a document during flat display, is attached to the opposite width end of the flexible backing material as shown (FIG. 8). The document fastener assembly is comprised of a folding lid 11 (FIGS. 6, 7, and 8), hinge 12 (FIGS. 6 and 8), holding fastener 13 (FIGS. 6, 7, and 8), and indentation 14 (FIGS. 6 and 8), which work collectively to form a snap fastener as shown. A clip 15 (FIG. 6) that extends the width of the flexible backing material extends to hold documents down during flat display. In the preferred embodiment, the folding lid, hinge, holding fastener, indentation, and clip consist of hard plastic.

A retracting handle 16 (FIGS. 1, 3, 4, 5, 6, and 8) for unfurling the flexible backing material and/or display documents from the cylindrical roller is secured to the document fastener assembly. The retracting handle has large flat surface areas, both top and bottom. In the preferred embodiment, the retracting handle consists of hard plastic. It also can consist of aluminum, fiberglass, wood, laminates, or other lightweight metal alloys. The retracting handle also has a single rectangular padded magnet 17 (FIG. 4) on its bottom surface and a single slot 18 (FIG. 4) designed to receive a variety of protruding nail head sizes. The magnet is used to mount the retracting handle to metal surfaces during flat display. The slot, sized to receive protruding nail heads of various sizes, is used to mount the retracting handle, to other surfaces during flat display.

Padded magnetic strips 19 (FIG. 4) also are attached as depicted to the bottom surface of the rectangular base. These magnetic strips, together with the padded magnet 17 (FIG. 4) attached to the bottom surface of the retracting handle are used to secure the unfurled display to metallic surfaces. Slots 20 (FIG. 4), sized also to receive the protruding heads of various sized nail heads, are provided on the bottom surface of the rectangular base as shown, like the single slot 18 (FIG. 4) provided on the bottom surface of the retracting handle. These three slots are used to secure the rectangular base mechanically, to both horizontal and vertical surfaces.

A square ridge 21 (FIGS. 3 and 5) along the top of the compact storage case is provided to store a scale rule 22 (FIGS. 5 and 10). A carrying handle 23 (FIGS. 1, 2, 3, 5, 14, and 15) is attached to, centered about the top of, and aligned with the long axis on the cylindrical case. In the preferred embodiment, the square ridge is hard plastic and molded to the top of the cylindrical carrier. In the preferred embodiment, the carrying handle is hard plastic and attached to the top of the compact storage case as shown (FIGS. 14 and 15) using two tab anchors 24 (FIGS. 14 and 15) and two sliding tabs 25 (FIGS. 14, 15, and 16).

ADVANTAGES

From the description above, a number of advantages of the portable blueprint carrier become evident:

a) The carrier will be significantly more compact and less expensive to produce—as a storage device—than the box-like or book-like folio devices which are larger than the blueprints they contain.

b) The carrier will have a functional relationship between the compact storage case and the flat display surface, allowing the user to quickly roll or unroll flexible backing material and/or documents attached to the flexible backing material on a cylindrical roller.

c) The carrier will conform in size to the typical dimensions of large construction documents, namely, rolled blueprints and surveys.

d) The relatively low cost and compactness of the device will allow a user to utilize the carriers solely as storage devices for multiple sets of documents.

e) The large VELCRO® brand hook and loop fastener surface area on the top of the flexible backing material, coupled with the VELCRO® brand hook and loop fastener mating strips attached to the back of the document fastening strips, will allow for the quick and easy transfer of documents for flat display.

f) The magnetic strips on the rectangular base and retracting handle will allow the flat display of documents on vertical and horizontal metallic surfaces common to construction sites.

g) The slots on the rectangular base and retracting handle, designed to receive protruding nail heads of various sizes, will allow the flat display of documents on non-metallic vertical and horizontal surfaces common to construction sites.

h) The flexible backing material which forms the flat display surface area may be quickly unfurled or retracted, both manually and, in another embodiment, by recoil spring.

i) The end of the document to be displayed, most distant from the cylindrical case, may be quickly snapped down for flat display using the document snap fastener.

j) Any rolled documents, which otherwise are part of a large bundle of documents and precede the document being displayed, may be folded back behind the carrier.

k) The carrier can be held in one hand using the carrying handle, during transport.

l) The carrier has a slot to receive a detachable scale rule (provided) for taking measurements.

Accordingly, the carrier can be used to easily and conveniently to store, transport, and display documents, both indoors and outdoors. The carrier has the additional advantage in that:

it protects documents from the elements during storage in a rolled form without requiring banding or tubing;

it allows for easy carrying during transport;

it permits easy interchangeability of documents for the display surface using mating VELCRO® brand hook and loop fasteners;

it provides both magnetic and mechanical means of fastening the carrier to metallic and non-metallic surfaces of all kinds for flat display;

it provides for the quick unfurling of a flat display surface and the ability to retract the documents upon a cylindrical roller inside of the carrier case;

it is lightweight;

it provides a slot for storing a built in scaled ruler for use in taking scaled measurement from the documents displayed; and it permits for compact storage.

Although the description above contains many specifications, these should not be construed as limiting the scope of the invention but merely as providing illustrations of some of the presently preferred embodiments of this invention. For example, the compact storage carrier and cylindrical roller can have many dimensions; the ends of the storage case can assume many geometric configurations (e.g. other than circles, squares, hexagons, and octagons); the flexible backing material can be made of flexible material other than the vinyl and be square rather than rectangular in shape; the mating VELCRO® brand hook and loop fastener pieces (hook and loop sides) can be reversed; the compact storage case and rectangular case can be made of aluminum, lightweight metal alloys, fiberglass or laminates; the cylindrical roller can be made of aluminum, wood, lightweight metal alloys, or laminates; the retracting handle and carrying handle can have other shapes; and other means of securing the documents can be utilized. Thus, the scope of the invention should be determined by the appended claims and their legal equivalents, rather than by the examples given.

What is claimed is:

1. A portable blueprint carrier and display device comprising:

A compact storage case, cylindrical in shape, wherein said cylindrical storage case has vertical end walls, and said cylindrical case is seated into a rectangular base, wherein the cylindrical case and rectangular base each have a form molded opening, which openings are aligned for the passage of flexible backing material and documents;

a cylindrical roller having a diameter smaller than that of said compact storage case, said cylindrical roller mounted to the interior ends of said compact storage case as to rotate axially in either direction within said compact storage case;

a section of flexible backing material attached to said cylindrical roller;

means for attaching and detaching the backs of display documents to the top of said flexible backing material, said attaching and detaching means including the use of hook and loop fastener material affixed to a large surface area of the top surface of the flexible backing material for mating with hook and loop document fastening adhesive strips attached to the backs of documents;

means for holding one end of a document down during display, said holding means including a document fastener assembly, wherein said document fastener assembly comprises a folding lid, hinge, holding fastener, and indentation, which work collectively to form a snap fastener, and wherein a clip that extends a width of said flexible backing material extends to hold documents down during horizontal or vertical flat display;

means for unfurling said flexible backing material manually, said unfurling means including a retractable handle comprised of flat top and bottom surfaces attached to said document fastener assembly, wherein said document fastener assembly is sized to fit squarely into said aligned, molded openings in the cylindrical storage case and the rectangular base;

means for retracting said flexible backing material upon said cylindrical roller, said cylindrical roller being fitted on one end with a manual retractor cap which extends beyond the vertical end wall of the compact storage case; and means for fastening said device during horizontal or vertical flat display, said fastening means including padded magnets and grooved slots positioned on the bottom of the rectangular base and retractable handle, wherein said grooved slots are sized to receive and securely encase protruding nail heads of various sizes.

2. The device of claim 1 where said retracting means includes a single recoil spring connected to one end of the cylindrical roller and cylindrical roller receiver.

3. The device of claim 1 where said retracting means includes dual recoil springs connected to both ends of the cylindrical roller and cylindrical roller receivers.

* * * * *